US007470310B2

(12) United States Patent
Kastner et al.

(10) Patent No.: US 7,470,310 B2
(45) Date of Patent: Dec. 30, 2008

(54) METHOD AND DEVICE FOR PRODUCING A STATIC BED

(75) Inventors: Rainer Walter Kastner, Zwettl a. d. Rodl (AT); Reinhard Pum, Traun (AT); Kurt Wieder, Schwertberg (AT); Johann Wurm, Bad Zell (AT); Hado Heckmann, Duesseldorf (DE)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 152 days.

(21) Appl. No.: 10/381,145

(22) PCT Filed: Aug. 27, 2001

(86) PCT No.: PCT/EP01/09853

§ 371 (c)(1),
(2), (4) Date: Jun. 23, 2003

(87) PCT Pub. No.: WO02/27043

PCT Pub. Date: Apr. 4, 2002

(65) Prior Publication Data

US 2004/0099094 A1 May 27, 2004

(30) Foreign Application Priority Data

Sep. 22, 2000 (AT) ..... A 1613/00

(51) Int. Cl.
*C21B 13/02* (2006.01)

(52) U.S. Cl. ..... 75/490; 266/172; 266/197

(58) Field of Classification Search ..... 75/492, 75/458, 460, 488, 490, 531, 549, 503, 506; 34/168, 165, 169, 170; 226/176, 171, 184
See application file for complete search history.

(56) References Cited

U.S. PATENT DOCUMENTS 3,799,368 A * 3/1974 Wieczorek ..... 414/206
4,074,836 A 2/1978 Muller, Jr. ..... 222/564
4,087,274 A 5/1978 Edenwall et al. ..... 75/10 R
4,846,449 A * 7/1989 Hauk et al. ..... 266/172
5,210,962 A * 5/1993 Jones, Jr. ..... 34/168
6,224,647 B1 * 5/2001 Vuletic ..... 75/381
6,562,102 B1 * 5/2003 Kepplinger et al. ..... 75/445

FOREIGN PATENT DOCUMENTS

DE 3328209 * 2/1985
DE 19623246 10/1997

(Continued)

OTHER PUBLICATIONS

Webster's Seventh New Collegiate Dictionary, third edition, 1965.*
English abstract of DE 3328209.*
International Search Report.

*Primary Examiner*—Roy King
*Assistant Examiner*—Tima M McGuthry-Banks
(74) *Attorney, Agent, or Firm*—Ostrolenk, Faber, Gerb & Soffen, LLP

(57) ABSTRACT

Apparatus and process for producing a fixed bed in a metallurgical unit, preferably for producing pig iron or primary steel products from iron-containing charge materials, in particular in a melted gasifier, in which a lumpy bulk material, which contains ore-containing and carbon-containing constituents, prereduced iron ore, preferably sponge iron, and preferably lumpy, coal, is charged onto a surface. Through mixing of the ore-containing constituent with the carbon-containing constituent of the bulk material takes place. The entire ore-containing constituent is charged onto an active circumferential or peripheral region of the fixed bed, at which the thorough, preferably uniform mixing of the ore-containing constituent with the carbon-containing constituent of the bulk material takes place preferably outward of the center. A device scatters the stream of bulk material aver the surface and less of the material is scattered at the center, so that heavier grain lumps segregate themselves toward the center.

17 Claims, 2 Drawing Sheets

FOREIGN PATENT DOCUMENTS

| | | | |
|---|---|---|---|
| JP | 59153815 | | 9/1984 |
| JP | 61-149409 | * | 7/1986 |
| JP | 01-219114 | * | 9/1989 |
| JP | 02 115309 | * | 4/1990 |
| JP | 02115309 | | 4/1990 |
| WO | WO97/46719 | * | 5/1997 |

* cited by examiner

METHOD AND DEVICE FOR PRODUCING A STATIC BED

FIELD OF THE INVENTION

The invention relates to an apparatus and a process for producing a fixed bed in a metallurgical unit, preferably for producing pig iron or primary steel products from iron-containing charge materials, in particular in a melted gasifier, in which a lumpy bulk material, which contains ore-containing and carbon-containing constituents, in particular prereduced iron ore, preferably sponge iron, and, preferably lumpy, coal, is charged onto a surface, and thorough, preferably uniform mixing of the ore-containing constituent with the carbon-containing constituent of the bulk material takes place.

BACKGROUND OF THE INVENTION

The distribution of a lumpy bulk material over an expansive surface is a problem which is known to specialists in the field of plant construction and process technology. Particularly in the case reactors used in chemical/physical process technology, considerable efforts are being made to achieve a bulk-material distribution which is optimized to a particular process. Incorrect loading of a reactor of this type can lead to a fall in the quality of the product, to high losses caused by the extraction of dust and to a reduction in productivity of the plant as a whole. The distribution of material is an important instrument in particular for adjusting the gas distribution.

In this respect, DE-C-19623246 describes an apparatus for the common, central introduction of coal and sponge iron into a melter gasifier. Although suitably thorough mixing of the substances is achieved, the central introduction of the coal/sponge iron mixture has not proven advantageous, for both process engineering and economic reasons.

In view of the prior art, it is an object of the present invention to further develop a process using an apparatus so as to achieve a more economical process and a more economical plant engineering design compared to the prior art.

The present invention has proven particularly advantageous when used in a melter gasifier and is documented in greatest detail in this connection. However, the use of the invention is not restricted to this embodiment, but rather the description of the actions in a melter gasifier merely represent an explanation given by way of example.

A melter gasifier, as is known in the prior art, is used to melt an iron ore which has been largely prereduced (DRI), and to produce reduction gas, preferably from coal.

The coal and the DRI are generally introduced into the melter gasifier via the dome of the gasifier; it has proven expedient for the coal to be introduced centrally. Accordingly, the DRI is introduced into the melter gasifier via a plurality of eccentrically located openings at the gasifier dome.

The invention is also characterized by a process for producing a fixed bed in a metallurgical unit, preferably for producing pig iron or primary steel products from iron-containing charge materials, in particular in a melter gasifier, in which a lumpy bulk material, which contains ore-containing and carbon-containing constituents, in particular prereduced iron ore, preferably sponge iron, and, preferably lumpy, coal, is charged onto a surface, and thorough, preferably uniform mixing of the ore-containing constituent with the carbon-containing constituent of the bulk material takes place, in which method the entire ore-containing constituent is charged onto an active circumferential region (peripheral region) of the fixed bed, at which the thorough, preferably uniform mixing of the ore-containing constituent with the carbon-containing constituent of the bulk material takes place.

In this context, the active circumferential region refers to that region of the fixed bed through which gases pass uniformly in sufficient quantities for the production of pig iron and/or reduction gas.

According to one feature of the invention, a coarse-grained fraction, in particular of the carbon-containing constituent, of the bulk material, which has a mean grain size which is greater than the mean grain size of the bulk material which is to be distributed, in particular of the carbon-containing constituent, is charged onto the centre of the surface, and in this way a, preferably steady state, predefined grain size distribution is produced.

According to a further feature of the invention, the bulk material, in particular the carbon-containing constituent of the bulk material, is distributed, via a charging apparatus, in a substantially rotationally symmetrical manner on the surface, less material than the amount which corresponds to the average at the other locations of the surface, between the centre and the outer edge of the active circumferential region of the fixed bed being applied to the centre of the surface by direct distribution.

According to an additional feature of the invention, the coarse-grained fraction, in particular of the carbon-containing constituent, of the bulk material is for the time being applied to the fixed bed at a distance from the centre, in such a manner that, consequently, it is automatically charged onto the centre of the surface by indirect distribution, in particular segregation.

According to a further embodiment of the process according to the invention, the lumpy bulk material is charged via one or more stationary charging apparatuses.

Charging may take place directly or indirectly.

By definition, direct charging means charging in which the bulk material in question, during its introduction, in particular into a reactor or a vessel, is loaded onto a predetermined region of a surface, in particular onto the centre of a surface.

By definition, indirect charging means charging in which, although the bulk material is introduced by direct charging, the resulting distribution over the surface is determined by further effects, in particular by segregation. In this way, it is possible for the bulk material to be distributed and charged in a controlled way onto a specific region of the surface, in particular onto the centre of the surface, even though this region has been omitted, or at least acted on to a lesser extent, by the direct charging, this being achieved for example by segregation i.e. indirectly.

Accordingly, the direct and/or indirect charging establishes a grain size distribution which remains substantially constant as the process continues, i.e. behaves in a steady state, over the surface.

According to one feature of the invention, the expansive surface is a surface through which gases can pass, in particular through which gases actually pass, process gas being guided in a controlled way through this surface. Passage of gas of this type is a significant feature of a corresponding process, for example the passage of gas through the fixed bed of a shaft furnace or melter gasifier.

It is a significant object of the process according to the invention to establish the bed of the gasifier in a suitable way, in order to prevent quantitative, pressure and analytical fluctuations in the gas system above the bed. Since a melter gasifier, as well as generating the pig iron, is also used to produce reduction gas, irregular gas flows significantly impede its operation. These irregularities may even lead to the formation of gas fountains, which lead to a sudden expulsion of dust from the unit. The discontinuous expulsion of dust, as arises, for example, through sudden carbonization, places a load on the downstream units, in particular a reduction shaft furnace.

Especially in the case of processes in which gas is supplied from the side, below the bed, there is insufficient passage of gases through the centre of the reaction bed given a load in accordance with the prior art. The invention provides countermeasures which significantly improve the process.

The formation of the fixed bed in a melter gasifier differs significantly from the charging of, for example, a blast furnace, since a melter gasifier is on the one hand a unit of a different specification, in particular different dimensions, and, on the other hand, the melter gasifier is operated using a different method, in which different loading means from those used, for example, in the blast-furnace method are used.

In a preferred process of this type, the energy carriers used are carbon-containing solids, in particular coal, and $O_2$-containing gas. According to the prior art, in this case the coal is conveyed out of a coal bunker using one or more worm conveyors and is added centrally, the coal therefore dropping in a narrow, concentrated jet through the gas chamber of the melter gasifier onto the bed surface. Furthermore, it is also conceivable for the coal not to be added centrally to the fixed bed, but rather separately via a plurality of part-streams.

Working on the basis of the central introduction of the coal into the gasifier, the coal, on account of the characteristic of the worm conveying, does not drop onto the centre of the bed surface, but rather drops slightly eccentrically, on account of the horizontal velocity of the worm discharge.

On account of the tendency for the charge to accumulate at certain points, and on account of relatively fine particles and the tendency of the coal to agglomerate, the passage of gas through the bed deteriorates at the central charging points. A cone of bulk material is formed and from time to time different volumes of this cone slip down suddenly into the circumferential region through which gases are passing. The coal passes into the hotter surrounding region and in the process is carbonized very rapidly.

Quantitative gas fluctuations with pressure influences and analytical fluctuations are the consequence, resulting in further adverse effects on the downstream gas system.

Furthermore, this slipping of the coal leads to an uneven and asymmetrical distribution of material at the circumference. Continuous heating of the burden is disrupted as a result, so that directly reduced iron (DRI) is heated to different extents at the circumference, and consequently it is impossible to establish a uniform temperature profile. Fluctuations in the quality of pig iron and slag are the result. Local differences in the slag composition at the circumference lead to disruption in the outgoing flow, and the desired slag composition in the hearth can only be established to an insufficient extent by mixing of the charge materials.

The punctiform charging of coal into the central region of the bed surface which is customary when loading the melter gasifier consequently leads to an uncontrolled formation of the bed surface and, depending on the segregation behaviour, to an unfavourable distribution of the various grain sizes of the bulk material.

Preferably, with charging of this nature, the larger grain will move outwards. The gas which flows through the bed from below consequently tends to be forced towards the wall of the gasifier and to be distributed in an uncontrolled manner through the fixed-bed cross section. High local gas velocities which may even lead to fountains being formed disturb the gas reactions in the gasifier dome and increase the discharge of dust. Consequently, there is a large area in the centre of the gasifier through which little gas flows. The volume of the active bed is therefore reduced, and the dead man in the centre or in the hearth is primarily supplied with relatively fine grains, so that the drainage deteriorates further. The dead man is a solid column shaped area of coal in the center area of the melter gasifier which forms due to insufficient oxygen in the center area to gasify the solid column shaped area of coal.

SUMMARY OF THE INVENTION

It is an object of the present invention for the coal not be charged onto one point in the gasifier, but rather for the coal to be scattered in a controlled way, with regard to its grain size, and in particular rotationally symmetrically, onto the bed surface. It should also be ensured that more lumpy coal is charged into the centre of the bed than onto the surrounding region, since this configuration of the process has proven particularly expedient.

It is a further significant object of the process according to the invention to establish the bed of the gasifier in a suitable way so as to prevent quantitative, pressure and analytic fluctuations in the gas system above the bed. Since a melter gasifier, as well as generating the pig iron, is also used to produce reduction gas, irregular gas flows represent a considerable disruption to its operation. These irregularities may even lead to the formation of gas fountains, leading to sudden expulsion of dust from the unit. The discontinuous expulsion of dust as arises, for example, through sudden carbonization represents a load on the downstream units, in particular the reduction shaft furnace.

This object is achieved by the uniform distribution of the coal or of the material of the bulk material which is enriched with carbon, onto the fixed bed, and therefore by simultaneously more homogeneous mixing of the coal with the directly reduced iron (DRI), in particular the area of the centre being supplied with at most the same volume of coal as the volume which is broken down above the dead man, in order to prevent the formation of a cone of bulk material. The volume which is broken down above the dead man is the amount of volume reduction which occurs when coal is converted by gasification to mainly carbon monoxide and ashes above the dead man.

In this case, particularly in the case of simultaneous and continuous charging of the lumpy coal and of the prereduced iron ore, in particular of the sponge iron, as with the loading of a melter gasifier, the mixing takes place particularly efficiently.

According to a preferred embodiment of the invention, a smaller volume of coal is applied by direct distribution to the centre of the fixed bed than the amount of volume reduction which occurs when coal is converted by gasification to mainly carbon monoxide and ashes above the dead man, so that the bed level falls, and in this way relatively lumpy coal is charged to the centre of the bed through segregation, i.e. indirect distribution. The lower level of this type, as well as the more lumpy coal in the centre of the fixed bed, lead to a greater degree of gas injection at the centre, and therefore to an increase in the active bed volume for the chemical or metallurgical processes of the melter gasifier.

The desired grain distribution at the bed of the melter gasifier can be achieved not only by indirect charging but also by direct charging, by which means the grain size distribution across the fixed bed is influenced in a controlled and direct manner. In this respect, consideration may be given to preliminary sorting of the bulk material according to grain size.

Movable, generally rotatable charging apparatus are known in the prior art for the purpose of charging blast and shaft furnaces. These charging devices can be used to adjust the distribution of the burden and of the ore, in particular in the region of the upper shaft, to the requirements of the process in a controlled way.

Compared to the prior art, an immobile, steady-state charging apparatus according to the invention has various advantages:

A significant advantage in this respect is the reduced susceptibility of the apparatus to mechanical and thermomechanical wear. Movable parts can only be used to a limited extent at elevated temperatures, since adaptation requires a disproportionately high outlay.

Furthermore, movable apparatus generally require a drive, which firstly in turn entails additional outlay on maintenance and secondly, if it is to move an apparatus which is able to withstand high temperatures and is robust, in particular specially reinforced, has to be dimensioned accordingly, and therefore requires a high outlay on energy.

According to one feature of the present invention, the coal is scattered by inserting a charging apparatus which ensures substantially uniform, in particular rotationally symmetrical, charging over the char bed surface into the falling jet of coal. Depending on the design of this charging apparatus, the surface profile can be set so that the flow of gas and solid in the fixed bed can be influenced in a controlled way. In particular, according to a further preferred embodiment of the invention, it is possible to carry out charging at a plurality of locations using one charging apparatus, by dividing the stream of bulk material.

A movable design of a charging apparatus according to the invention is also conceivable, so that individual regions of the surface, in particular of the fixed bed, are supplied with, in particular presorted, bulk material in a controlled way.

The appropriate scattering and distribution of the coal over the bed surface in accordance with this process, with relatively lumpy coal being situated in the centre of a melter gasifier, through which the passage of gases tends to be worse, leads to the charged coal being exposed to the hot gas more uniformly and being carbonized continuously. Sudden movements of material from cooler regions into hotter regions are prevented, and the production of gas is made more uniform or is stabilized. The scattering of the coal also prevents an irregular flow of the central cone of bulk material towards the outside.

In this way, a homogeneous build-up of material on the char bed (bed of the lumpy coal) is ensured, and consequently not only the gas production but also the composition of the slag and pig iron at the circumference (active bed region) are made more uniform. This leads to more homogeneous guidance of the slag, with an improved drainage performance. This in turn has positive effects on the heat exchanger function in the fixed bed and on the quality of the pig iron.

The predetermined scattering of coal onto the char bed surface prevents the flow of material starting from a central cone of bulk material. Sudden, uncontrolled slipping of a relatively large volume of coal towards the outside is no longer possible.

The scattering of the coal onto the bed surface reduces the formation of agglomerates which disrupt the flow of material in the gasifier, since there is not an excessively great accumulation of material which is in the same stage of pyrolysis.

Furthermore, the scattering leads to uniform carbonization, since the coal is charged directly into the area through which gases pass and does not slip down in an uncontrolled way, leading to sudden carbonization.

The symmetrically and uniformly distributed coal has the further advantage that it is mixed homogeneously with the DRI at the circumference. Uniform quantities of pig iron and slag, as well as their approximately constant composition at the circumference, improve the metallurgical conditions in the gasifier bed above the oxygen nozzles. Consequently, the slag can flow out more easily and the gas passage and drainage conditions are improved.

When using an immobile, steady-state, in particular undriven charging apparatus which is situated above the centre of the gasifier, according to one embodiment of the invention, the coal is distributed, in particular rotationally symmetrically, over a large surface, without any coal being charged into the centre of the gasifier. Through segregation, the lumpy coal passes into the centre and into the area of the dead man. This has the result of the dead man being supplied with lumpy coal, so that the drainage is improved all the way to the tap. The DRI content in the area where the heat flux is low on account of a low gas velocity (poor heat conduction) is to be kept low.

Controlled formation of the char bed surface profile of this type and the regulated grain size distribution over the cross-sectional area allow the gas flow and the outgoing flow of the liquid phase to be influenced. The conditions for heat exchange in the fixed bed are improved, so that the energy consumption is reduced. Keeping the gas flow away from the wall protects the refractory lining.

As a result of the centre of the melter-gasifier fixed bed being supplied with coarse lumps of coal, the dead man is formed with a relatively large void volume, so that it is possible to transfer increased quantities of heat into this region through the flow of gas and to allow the liquid phase to flow out in this region, and also to minimize the disruptions above the gasifier zone. Making the passage of gas more uniform reduces the dust content in the process gas. Consequently, less dust is carried into the reduction shaft, the load on the dust recycling system is relieved and the losses of sludge in the process are reduced.

According to a preferred embodiment of the invention, it is provided to fit a charging apparatus which divides the stream of bulk material into a plurality of part-streams, so that in this way, by direct or indirect distribution, more lumpy coal is charged into the centre or at a different location which is predetermined by the process, in particular of the melter gasifier.

Combinations of charging apparatuses which make use of direct and/or indirect distribution form further embodiments of the invention.

The invention is also characterized by a process according to the invention for distributing a lumpy bulk material, in particular a lumpy coal, from a stream of bulk material onto an expansive surface, in particular onto a fixed bed, this surface preferably extending within a reactor or vessel used in physical or chemical process engineering, in particular in a reactor of a smelting plant for producing pig iron or primary steel products, and the lumpy bulk material being charged via a charging apparatus, the material being distributed radially outwards—as seen from above—by a means for radial distribution, in which process, furthermore, the bulk material, before it comes into contact with the means for radial distribution, is scattered at a means for scattering in the radial and tangential directions, as seen from above.

According to one feature of the process according to the invention, prior to the scattering of the bulk material, the stream of bulk material, in a, preferably first, step of the process, is centred, as a result of the stream of bulk material being conveyed onto a centring means and the bulk material flowing through a number of centring openings of the centring means, any overflow of the bulk material which may occur flowing away through at least one discharge means, in particular through a further opening.

According to a further feature of the invention, the bulk material forms a cone of bulk material on the centring means.

According to an additional feature of the invention, a coarse-grained fraction of the bulk material which has a mean grain size which is greater than the mean grain size of the total distributed bulk material is charged, in particular using segregation, onto a predetermined region of the surface, in particular onto a centre of the surface, a, preferably steady-state, predefined grain size distribution being produced in this way.

By definition, the term grain size distribution means the quantitative proportion of each grain fraction at a location with respect to the total quantity of grains at this location.

By definition, what is known as a steady-state behaviour of the grain size distribution means that a grain size distribution which is approximately constant over time with respect to the particular location is present. Furthermore, according to a further embodiment of the invention, the quantity of grains of one fraction also, as a function of the location of the surface, presents a substantially time-independent behaviour in relation to the total quantity of the grains of the respective fraction on the surface.

The invention is also characterized by an apparatus according to the invention for distributing a lumpy bulk material, in particular a lumpy coal, from a stream of bulk material onto an expansive surface, in particular onto a fixed bed, this surface preferably extending within a reactor used in physical or chemical process engineering, in particular in a reactor of a smelting plant for producing pig iron or primary steel products, in which apparatus, to charge the lumpy bulk material, a charging apparatus is provided, which has at least one means for radially distributing the bulk material radially outwards—as seen from above—in which apparatus, furthermore, the charging apparatus, upstream of the radial distribution means, has at least one means for scattering the bulk material, which is arranged in the upper part of the reactor and is preferably stationary, it being possible for at least a fraction of the bulk material to be distributed in the radial and tangential directions, as seen from above.

The apparatus according to the invention leads to the bulk material, in a first step, being scattered uniformly and, in a second step, being distributed radially outwards.

According to a preferred embodiment, the radial distribution is characterized in that a specific part of the surface is in the shadow of the radial distribution means and is therefore loaded with less bulk material. A scattering cone which is known in the prior art not only effects radial distribution but also places a predetermined area of a surface under its shadow.

According to a preferred embodiment of the invention, the radial distribution means is designed as a fixed apparatus arranged beneath the scattering means.

According to one feature of the apparatus according to the invention, the radial distribution means has a rotationally symmetrical part which tapers in the opposite direction to the flow of bulk material, in particular is conical, and, if appropriate, a rod-like part, the tapering part if appropriate centrally adjoining the rod-like part, as seen in the direction of flow of the bulk material.

According to further embodiments, convex and concave structures, as well as substantially pyramid-shaped bodies, and also combinations thereof, are possible, provided that they have the function of radially distributing the bulk materials.

The rod-like part of the radial distribution means, which is optionally present, is also used to fix and position the conical part.

The conical part effects a radial distribution of the bulk material as a result of the bulk material rebounding off the lateral surface or sliding along this surface, and thereby being subjected to a specific distribution.

In this case, that part of the surface, in particular of the fixed-bed surface, which is covered by and in the shadow of the cone or, in the case of the bulk material rebounding off and sliding down the cone lateral surface, its imaginary elongated lateral surface, is loaded with less bulk material by direct distribution than the quantity which would correspond to the cross section of the remaining part of the surface.

According to a particularly preferred embodiment, the tapering part of the radial distribution means has at least one cone or truncated cone with an included angle between the generating line and the centre line of less than 60°, preferably in the range from 10-60°.

The radial distribution means is made from heat-resistant and wear-resistant material and/or has what are known as material cushions. At its base surface, the cone or truncated cone preferably has a diameter of 50% of the diameter of the scattering means or of the feed cross section.

According to one feature of the invention, at least one means for centring the flow of bulk material is provided upstream of the scattering means.

This ensures that the flow of bulk material comes into contact with the scattering means at its centre.

Furthermore, the invention is characterized by a scattering means which is preferably suitable for use in an apparatus in which case the scattering means has a number of rod-like and/or plate-like elements which are connected to one another and together approximately describe the shape of a body which tapers in the opposite direction to the direction of flow of the bulk material, in particular in the shape of a pyramid, and has a plurality of openings.

Furthermore, the invention is characterized by a scattering means which is preferably suitable for use in an apparatus in which case the scattering means has a number of rings, which together approximately describe the shape of a body which tapers in the opposite direction to the direction shape of a cone, and has a plurality of openings, and are connected to one another at least along a generating line.

This is in particular a pyramid-shaped body, the edge lines of whose imaginary lateral surface are connected by webs, in particular of rotationally symmetrical cross section.

The stream of bulk material, which has preferably been concentrated, is in this case distributed or scattered uniformly, for example onto the char bed (bed of lumpy coal) of the melter gasifier.

In the process, the bulk material is scattered by, often repeated, deflection, the particular design according to the invention resulting in scattering of the bulk material which is considerably more uniform than that achieved in the prior art.

According to the invention, the bulk material is distributed, the bulk material being distributed in a plane which is perpendicular to the direction of the flow of bulk material, or—as seen from above—in the radial and tangential direction.

A scattering cone which is known in the prior art and is disclosed, for example, in EP-A-0 076 472, by contrast, primarily effects distribution of the bulk material in—as seen from above—the radial direction within a tight ring.

Furthermore, the scattering means according to the invention effects scattering, starting from the stream of bulk material, as seen from above, not only in the radially outward direction but also in the radially inward direction. The particular form of the tapering, in particular pyramid-shaped body, according to the invention, effects radial scattering, with a tendency, at any rate, for more material to be scattered outwards, over a greater radius, than inwards, over a small radius.

According to a further feature according to the invention, the scattering means has a number of approximately annular bodies, which approximately describe the shape of a body which tapers in the opposite direction to the direction of flow of the bulk material, and in particular, is in the shape of a cone.

According to a particular embodiment, the annular bodies are connected to one another along one or more generating lines.

According to a further feature, the scattering means must cover the entire cross section of the flow of bulk material.

According to an additional feature, the openings on the scattering means are at least as large as the maximum size of the material which is to be charged.

According to one embodiment of the invention, the rod-like, annular or plate-like elements are made from wear-resistant, high-impact-strength, heat-resistant materials, and/or preferably have a rectangular or triangular cross section.

Furthermore, the invention is characterized by a means for centering a flow of bulk material for use in an apparatus having at least one centering opening, in which at least one discharge means, preferably a further opening, is provided, through which any overflow of bulk material which occurs during centering of the flow of bulk material can be discharged.

According to one feature of the invention, the centring means is designed as a metal centring sheet which has an annular metal sheet with an inner radius and an outer radius, from which at least a partial region, in particular a ring segment or a ring sector, has been removed.

According to a further feature of the invention, the metal centring sheet is designed in such a manner that a ring segment with a central angle of 180° has been removed from the annular metal sheet.

The metal centring sheet in a charging apparatus is used to concentrate and centre the flow of bulk material or the bulk material itself, which is conveyed out of a bunker, for example by conveyor worms. Removal of this type always leads to an exit curve which varies according to the rotational speed or conveying capacity.

In this case, the metal centring sheet is designed in such a manner that it has at least one first opening, which has the purpose of centring the bulk material, and at least one discharge means, preferably an opening for discharging any overflow which occurs. An overflow of this nature forms if the first, concentrating opening according to the invention is full or blocked.

In particular, this metal centring sheet is designed in such a manner that at least a part, in particular at least a sector of a circle or a ring segment, has been removed from an annular metal sheet having an inner radius and an outer radius.

Alternative designs have, by way of example, curved or funnel-shaped metal centring sheets.

In the case of an annular design, the centring opening of the metal centring sheet is advantageously in the form of the central opening in the metal sheet which is delimited by the ring. The further openings, which corresponds to the discharge means, may be provided in such a way that they adjoin the centring opening, and in this way cannot be structurally distinguished from the latter. However, in functional terms they are separate, since these further openings are used to discharge the overflow.

The metal centring sheet of a charging apparatus is arranged in such a manner that the conveyor means, in particular the said worm conveyors, conveys the bulk material onto the metal centring sheet, and in doing so preferably does not load that part of the metal sheet which has the discharge means, for example the additional further openings for the material which accumulates on the metal centring sheet in the event of the first centring opening being blocked to flow out.

In this case, a cone of bulk material is formed, in a particularly advantageous way, on the metal centring sheet, from which cone material flows through the said first, centring opening and is centred in this way.

The design according to the invention ensures that, in the event of the centring opening in the metal centring sheet becoming blocked, in particular for a short time, the bulk material can flow out via the said discharge means.

Compared to the devices for centring the flow of bulk material which are known in the prior art, a series of advantages are achieved:

Particularly in the case of a feed by means of a conveyor worm, the parabolic path of the flow of bulk material must be taken into account. The horizontal velocity which arises leads to a predefined offset of the flow of bulk material and therefore to it making eccentric contact with the material-distribution apparatus.

In addition, when using an apparatus which is known from the prior art, for example a pipe of narrowing diameter, a change in the throughput quantity can lead to the means for centring the flow of bulk material becoming full or blocked. By contrast, the design-of the metal centring sheet according to the invention has, irrespective of one or more centring openings, at least one means for discharging the material in the event of an overflow.

According to one embodiment of the invention, the size of the concentrating opening is at least 6 to 10 times the maximum diameter of the bulk material conveyed.

Compared to the prior art, the build-up of the cone of bulk material and the downward sliding of the bulk material on the cone of bulk material which is brought about in this way, through the centring opening, results in a much lower mechanical or thermomechanical load on the apparatus. Furthermore, the centring means is made from materials which are able to withstand high temperatures and are highly wear-resistant.

BRIEF DESCRIPTION OF THE DRAWINGS

Non-limiting exemplary embodiments of the invention are explained in more detail below with reference to diagrammatic drawings, in which.

DESCRIPTION OF A PREFERRED EMBODIMENT

Figure 1:
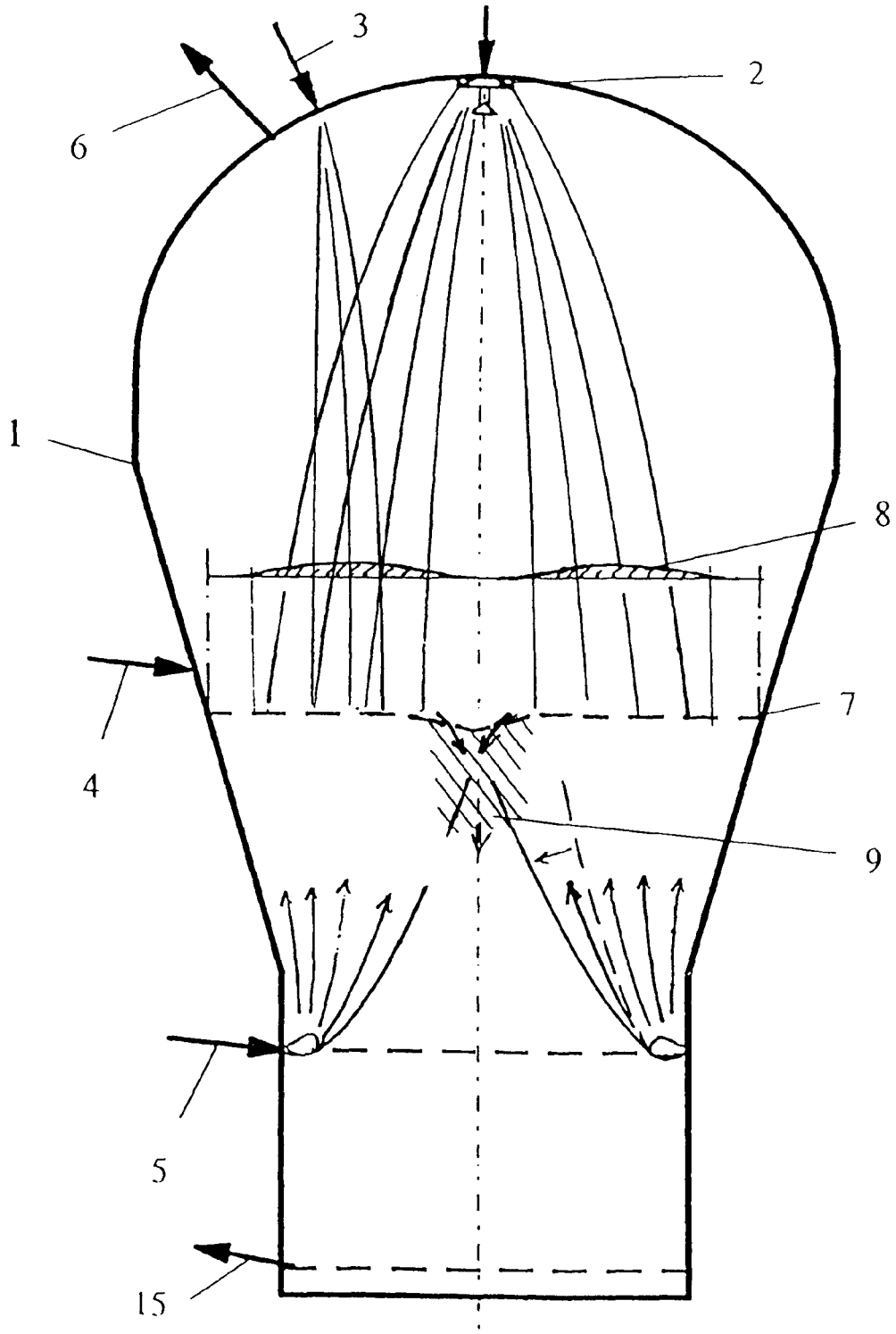
FIG. 1 diagrammatically depicts the distribution of coal in a melted gasifier using the example of a steady-state charging apparatus

FIG. 1 shows a diagrammatic sketch of the distribution of coal in a melter gasifier 1. In this case, starting from a steady-state charging apparatus 2, the coal is introduced into the melter gasifier. In addition, there are an DRI introduction means 3, for example through a plurality of openings which are arranged concentrically with regard to the coal introduction means, a dust return means 4, an oxygen introduction means 5, and a slag and pig iron tap 15, as well as a gas discharge means 6 on the melter gasifier 1.

The coal is distributed uniformly over the rotationally symmetrical bed 7 of the melter gasifier 1, the particular design of the charging apparatus 2 meaning that no coal, or at least little coal, is charged to the centre. The distribution of the coal brought about by direct introduction is diagrammatically illustrated in FIG. 1, in which in particular a profile of the coal distribution 8 is diagrammatically sketched.

Accordingly, the mass flow rate at the surface which lies at approximately half the radius is significantly higher than in the centre of the bed.

Segregation leads to a change in the coal distribution and, in particular, of the grain size distribution of the char bed, since larger, more lumpy coal slips down into the centre of the bed and in this way enters the zone of what is known as the dead man 9. In this way, the dead man and hearth are supplied with relatively lumpy coal (char). The particular distribution of in particular the relatively lumpy coal leads to widening of the active char bed, which consequently leads to an increased passage of gases through the centre.

Figure 2:
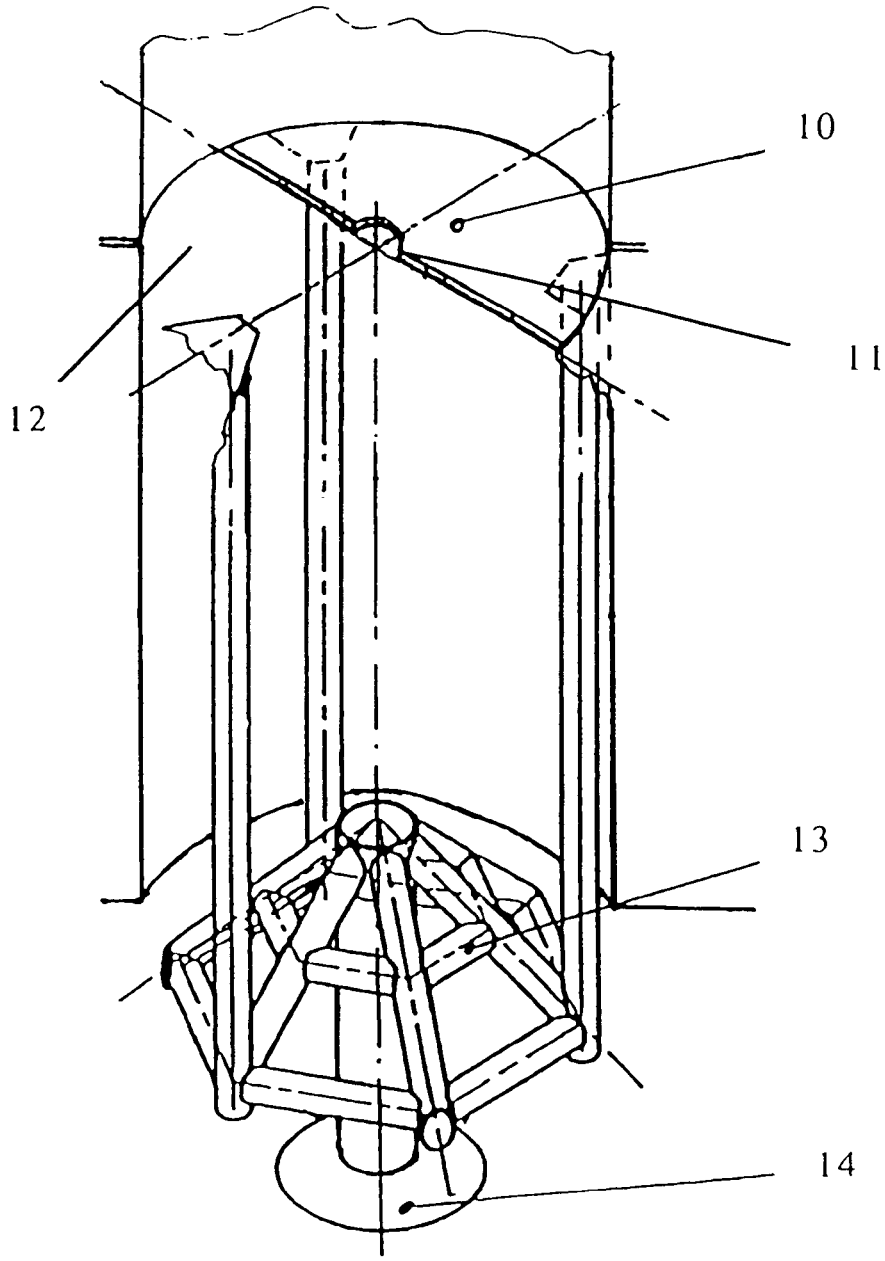
FIG. 2 shows an exemplary embodiment of a steady-state charging apparatus according to the invention.

FIG. 2 diagrammatically depicts a steady-state charging apparatus 2 according to the invention. This charging apparatus has a metal concentrating sheet 10, which is used to concentrate the flow of bulk material, which is once again conveyed out of a bunker by conveyor worms. This metal concentrating sheet 10 is designed in such a manner that a half, which is symmetrical with respect to an external diameter of the metal sheet, has been removed from an annular metal sheet. The metal concentrating sheet has a concentrating opening 11, as well as an opening 12 for discharging the overflow.

The design of the metal concentrating sheet according to the invention means that, irrespective of the centring opening of the metal concentrating sheet itself, a large part of the charging opening of the melter gasifier remains uncovered, thus allowing an overflow of bulk material.

Below the metal concentrating sheet, the concentrated flow of bulk material is distributed by a scattering means 13, which in the present case is a coal channeler, a particular design of a deflector, uniformly into the free space or onto the surface of the char bed of the melter gasifier. Tests have shown that the shape of the coal channeler has a considerable influence on the quality of the distribution of the coal onto the char bed, and the illustrated form of the coal channeler has proven particularly useful. In this case, the coal channeler 13 is approximately in the shape of a pyramid, thus enabling the bulk material to be scattered.

Beneath the coal channeler 13 there is a radial distribution means 14, having a cone which stops the centre of the char bed from being fed or at least reduces the quantity of bulk material which is charged to this region. According to a further embodiment according to the invention, this cone may be attached to a cylindrical part and has, in particular, an included angle between generating line and centre line of approximately 10-60°. An included angle of 30° to 45° is particularly preferred.

All parts of the apparatus presented above have to be adapted to the environmental conditions in their respective area of use. When used in a melter gasifier, primarily materials which are able to withstand high temperatures and have a high resistance to wear are used. Furthermore, consideration may be given to providing a refractory lining for those parts which are exposed to particularly high temperatures.

Those parts of the apparatus presented above which experience has shown are exposed to a particularly high load caused by wear are additionally protected by cladding, for example by welding on metal sheets which are highly wear-resistant.

The invention claimed is:

1. Apparatus for distributing a lumpy bulk material including carbon-containing material from a stream of the bulk material onto an expansive surface of a fixed bed located within a vessel used in a physical or chemical process engineering, the apparatus comprising:

an inlet device for delivering the stream of bulk material into the vessel above the fixed bed;

a scattering device in the vessel in communication with the inlet device which is operative to receive the bulk material and to scatter at least a portion of the bulk material radially and tangentially with respect to the surface, said scattering device having a generally tapered body portion which narrows at an upstream end thereof relative to the direction of flow of said bulk material, said body portion comprised of a plurality of vertically spaced marginal rings spaced to provide a plurality of openings throughout the body, said rings being connected to one another at least along a generating line, wherein the rings together approximately define the shape of the body and the vertical spaces define the plurality of openings; and a charging apparatus having at least one distribution device downstream of the scattering device, which is operative to receive at least a portion of the lumpy material exiting the scattering device and to distribute the received portion radially outward over the surface.

2. The apparatus of claim 1, wherein the scattering device and the charging apparatus are so shaped and operative to distribute the majority of a coarse-grained fraction of the carbon-containing constituent of the bulk material to be applied to the fixed bed surface at a distance out from the center and in such a manner that a larger mean grain size portion of the coarse-grained fraction automatically charges onto the center of the vessel by indirect distribution and segregation as the carbon-containing constituent builds up on the surface outward of the center.

3. The apparatus of claim 1, wherein the vessel is a reactor of a smelting plant for producing pig iron or primarily steel products.

4. The apparatus of claim 1, further comprising at least one centering device for centering the stream of bulk material and located upstream of the scattering device in the path of the bulk material into the vessel.

5. The apparatus of claim 4, wherein the centering device comprises:

a centering opening for the bulk material into the vessel; and a further opening at the centering device for discharge of excess bulk material which may arise during centering of the stream of bulk material.

6. The apparatus of claim 5, wherein the centering device is comprised of an annular metal sheet with an inner radius and an outer radius and a partial region which is removed from the sheet.

7. The apparatus of claim 6, wherein the partial region is a ring segment having a central angle of 180° which has been removed from the annular metal sheet.

8. The apparatus of claim 1, further comprising a centering device for controlling the distribution of the stream of lumpy bulk material being delivered into the vessel for subsequent scattering radially and tangentially on the fixed bed, the centering device comprising:

a metal plate disposed in the vessel and oriented with a surface thereof in the stream of incoming lumpy bulk material; wherein:

the plate has a central, substantially circular opening therein defining an annular configuration for the plate; and the plate has a partial region thereof removed to provide a further opening for discharge of excess bulk material which may arise during centering of the stream of bulk material.

9. The apparatus of claim 6, wherein the partial region is in the form of a ring segment or a ring sector.

10. The apparatus of claim 9, wherein the partial region is in the form of a ring segment which has a central angle of 180°.

11. A process for producing a fixed bed in a melter gasifier, comprising the steps of:

a) charging a lumpy bulk material, which contains prereduced iron ore and carbon-containing constituents onto a surface, b) introducing the prereduced iron ore and the carbon-containing constituents into the melter gasifier through different openings, c) introducing the prereduced iron ore via a plurality of decentralized located openings and introducing the carbon-containing constituents centrally via a charging apparatus, d) distributing the carbon-containing constituents radially outwardly by a means for radial distribution, and thoroughly mixing the prereduced iron ore with the carbon-containing constituents, e) charging the entire prereduced iron ore onto an active circumferential peripheral region of the fixed bed, f) scattering the carbon-containing constituents at a means for scattering in the radial and tangential directions, before they come into contact with the means for radial distribution, g) charging a coarse-grained fraction of the carbon-containing constituents, which has a mean grain size which is greater than the mean grain size of the carbon-containing constituents, onto the center of the surface by indirect distribution, thereby producing a predefined grain size distribution, and h) charging a fraction of the carbon-containing constituents onto the center of the surface by direct distribution, the volume of the fraction of the carbon-containing constituents charged onto the center of the surface by direct distribution being less than the amount of volume reduction which occurs when the carbon-containing constituents are converted by gasification to mainly carbon monoxide and ashes above the dead man, so that the bed level in the center of the surface falls, thereby causing the charging of the coarse-grained fraction by indirect distribution onto the center of the surface.

12. A process according to claim 11, wherein the carbon-containing constituents are distributed, via a charging apparatus, in a substantially rotationally symmetrical manner on the surface, excluding material in an amount which corresponds to an average at other locations of the surface, between the center and the outer edge of the active circumferential region of the fixed bed.

13. A process according to claim 11, wherein the coarse-grained fraction of the carbon-containing constituents is temporarily applied to the fixed bed at a distance from the center, above the bed level in the center, due to the falling of the bed level in the center, whereby the coarse-grained fraction is automatically charged subsequently onto the center of the surface by indirect distribution.

14. A process according to claim 12, wherein the coarse-grained fraction of the carbon-containing constituents is temporarily applied to the fixed bed at a distance from the center, above the bed level in the center, due to the falling of the bed level in the center, whereby the coarse-grained fraction is automatically charged subsequently onto the center of the surface by indirect distribution.

15. A process according to claim 11, wherein the stream of the bulk material of the carbon-containing constituents is centered, prior to the scattering, as a result of it being conveyed onto a centering means and with the bulk material flowing through a number of centering openings of the centering means, with any overflow of the bulk material, which may occur, flowing away through at least one discharge means.

16. A process according to claim 12, wherein the stream of the bulk material of the carbon-containing constituents is center prior to the scattering, as a result of it being conveyed onto a centering means and with the bulk material flowing through a number of centering openings of the centering means, with any overflow of the bulk material, which may occur flowing away through at least one discharge means.

17. A process according to claim 13, wherein the stream of the bulk material of the carbon-containing constituents is centered prior to the scattering, as a result of it being conveyed onto a centering means and with the bulk material flowing through a number of centering openings of the centering means, with any overflow of the bulk material, which may occur, flowing away through at least one discharge means.

* * * * *